US012740678B2

(12) United States Patent
Roschi

(10) Patent No.: US 12,740,678 B2
(45) Date of Patent: Sep. 22, 2026

(54) MOTORIZED SUCTION HEAD WITH STEAM DISPENSING DEVICE

(71) Applicant: NEW ERMES EUROPE S.R.L., Crosio Della Valle (IT)

(72) Inventor: Riccardo Roschi, Crosio Della Valle (IT)

(73) Assignee: NEW ERMES EUROPE S.R.L., Crosio Della Valle (IT)

( * ) Notice: Subject to any disclaimer, the term of this patent is extended or adjusted under 35 U.S.C. 154(b) by 371 days.

(21) Appl. No.: 18/549,535

(22) PCT Filed: Mar. 11, 2022

(86) PCT No.: PCT/EP2022/056288
§ 371 (c)(1),
(2) Date: Sep. 7, 2023

(87) PCT Pub. No.: WO2022/189608
PCT Pub. Date: Sep. 15, 2022

(65) Prior Publication Data

US 2024/0138636 A1 May 2, 2024

(30) Foreign Application Priority Data

Mar. 11, 2021 (IT) ..... 102021000005708

(51) Int. Cl.
*A47L 9/04* (2006.01)
*A47L 9/24* (2006.01)
(Continued)

(52) U.S. Cl.
CPC ..... *A47L 9/0477* (2013.01); *A47L 9/242* (2013.01); *A47L 9/2842* (2013.01);
(Continued)

(58) Field of Classification Search
CPC ..... A47L 9/04; A47L 9/06; A47L 9/282
See application file for complete search history.

(56) References Cited

U.S. PATENT DOCUMENTS 2,558,590 A 6/1951 Smith
3,755,850 A 9/1973 Porter
(Continued)

FOREIGN PATENT DOCUMENTS

CN 211130861 U 7/2020
DE 102018116547 A1 1/2020
(Continued)

OTHER PUBLICATIONS

Search Report and Written Opinion of IT Application No. 202100005708 dated Dec. 2, 2021, 12 pages.
(Continued)

*Primary Examiner* — Michael D Jennings
(74) *Attorney, Agent, or Firm* — NIXON & VANDERHYE P.C.

(57) ABSTRACT

A motorized suction brush comprising a roller is described, the roller being rotatable and being configured to rub the surface to be cleaned, an electric motor, either a battery or a transformer being electrically connected to the electric motor, and a transmission for connecting the roller to the electric motor so as to rotate the roller, wherein the suction head further comprises a fluid dispensing device, wherein said fluid comprises steam and/or comprises a liquid with a cleaning substance and/or a disinfectant substance.

9 Claims, 11 Drawing Sheets

(51) Int. Cl.
*A47L 9/28* (2006.01)
*A47L 11/20* (2006.01)
*A47L 11/40* (2006.01)

(52) U.S. Cl.
CPC ..... *A47L 9/2857* (2013.01); *A47L 9/2884* (2013.01); *A47L 9/2889* (2013.01); *A47L 11/201* (2013.01); *A47L 11/4088* (2013.01)

(56) References Cited

U.S. PATENT DOCUMENTS

| | | | | |
|---|---|---|---|---|
| 4,507,819 | A | 4/1985 | Martinec | |
| 5,455,984 | A | 10/1995 | Blase | |
| 6,263,539 | B1 | 7/2001 | Baig | |
| D599,065 | S | 8/2009 | Roschi | |
| 7,757,345 | B2 | 7/2010 | Roschi | |
| 7,797,793 | B2 | 9/2010 | Roschi | |
| D807,603 | S | 1/2018 | Roschi | |
| 10,238,254 | B2 | 3/2019 | Roschi | |
| D900,420 | S | 10/2020 | Roschi | |
| D922,014 | S | 6/2021 | Roschi | |
| 11,224,319 | B2 | 1/2022 | Roschi | |
| D953,673 | S | 5/2022 | Roschi | |
| 11,564,544 | B2 | 1/2023 | Roschi | |
| 2004/0045126 | A1* | 3/2004 | Parker | A47L 11/4013 15/403 |
| 2007/0266678 | A1* | 11/2007 | Makarov | A47L 9/1666 55/337 |
| 2007/0277345 | A1* | 12/2007 | Spann | A47L 9/06 15/395 |
| 2010/0274162 | A1* | 10/2010 | Evans | A61H 15/0092 601/46 |
| 2011/0232687 | A1* | 9/2011 | Stein | A47L 9/2842 134/21 |
| 2017/0280956 | A1* | 10/2017 | Roschi | A47L 5/28 |
| 2017/0319026 | A1 | 11/2017 | Roschi | |
| 2019/0174983 | A1 | 6/2019 | Roschi | |
| 2020/0046184 | A1* | 2/2020 | Freese | A47L 5/30 |
| 2021/0393102 | A1* | 12/2021 | Bian | A47L 11/4086 |

FOREIGN PATENT DOCUMENTS

| | | | |
|---|---|---|---|
| EP | 1898767 | A1 | 3/2008 |
| EP | 2890286 | A1 | 7/2015 |
| EP | 3714754 | A1 | 9/2020 |
| GB | 610918 | A | 10/1948 |
| KR | 100613475 | B1 | 8/2006 |
| WO | 2006133886 | A1 | 12/2006 |
| WO | 2014122542 | A1 | 8/2014 |

OTHER PUBLICATIONS

International Search Report for PCT/EP2022/056288 dated Aug. 22, 2022, 5 pages.
Written Opinion of the ISA for PCT/EP2022/056288 dated Aug. 22, 2022, 10 pages.
U.S. Appl. No. 18/479,577, filed Oct. 2, 2023, "Battery Holder for a Battery-Operated Power Tool or for a Vacuum-Cleaner Brush".
U.S. Appl. No. 18/259,022, filed Jun. 22, 2023, "Motorized Suction Head".
Communication pursuant to Article 94(3) EPC dated Oct. 9, 2025 in European application 22 712 408.8-1015.

* cited by examiner

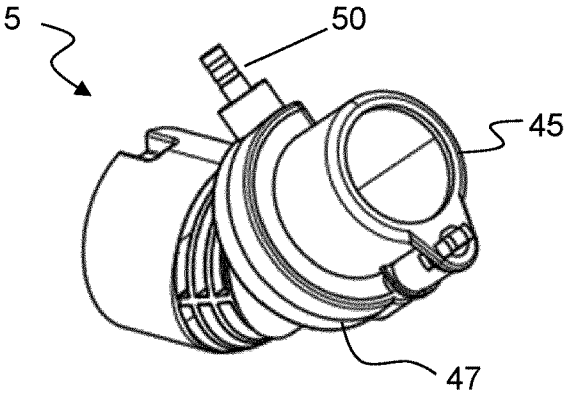
Fig. 8.1
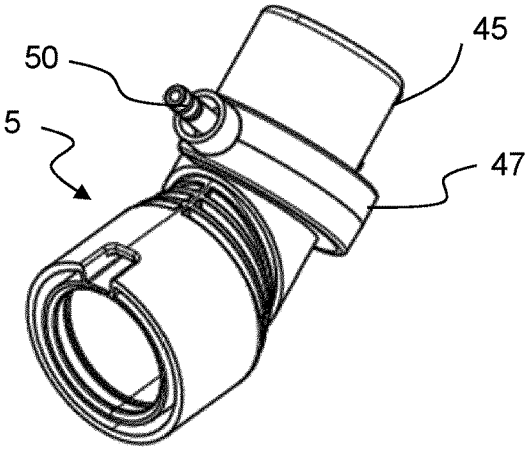
Fig. 8.2
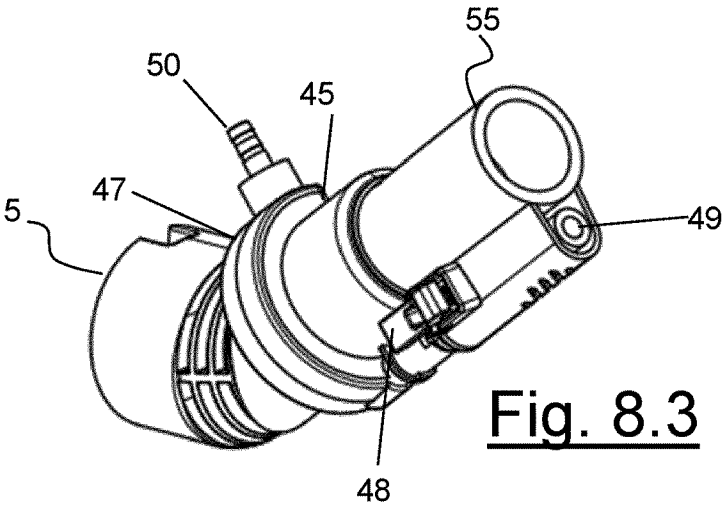
Fig. 8.3
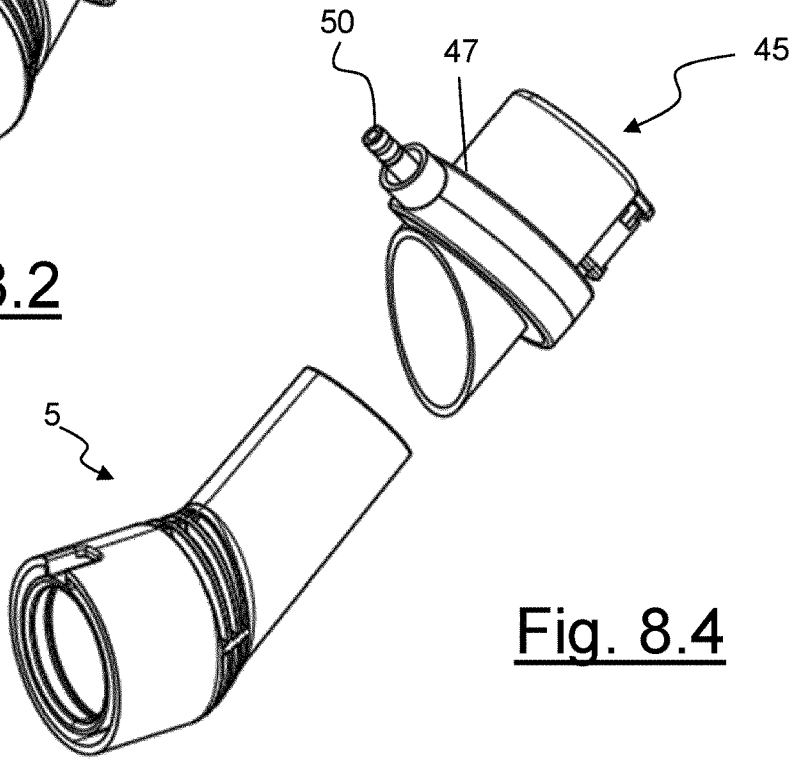
Fig. 8.4

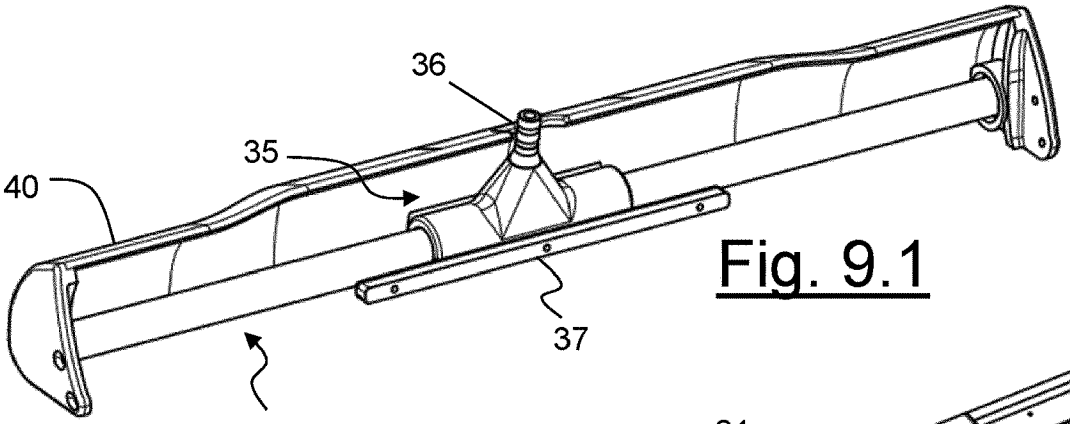
Fig. 9.1
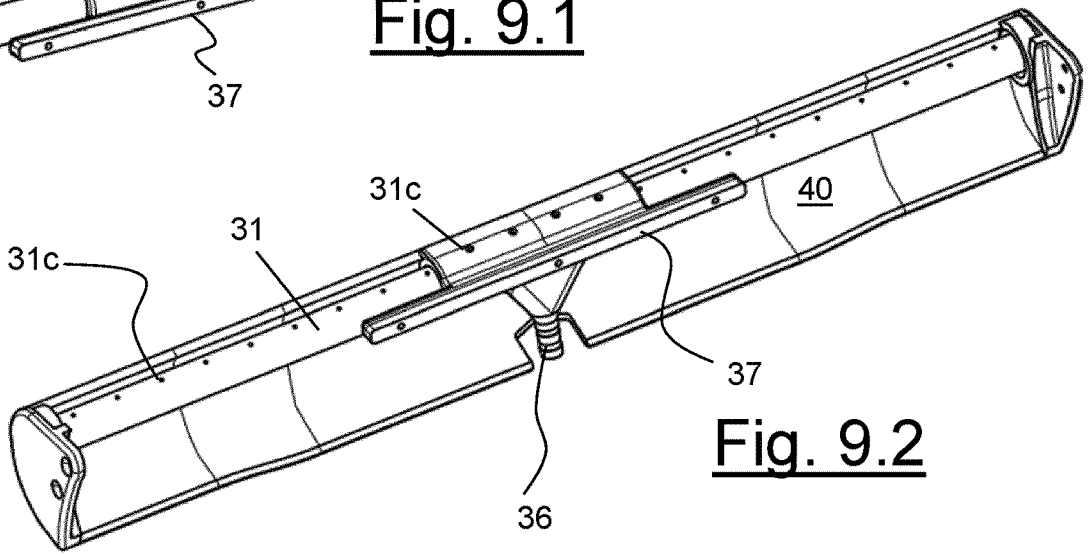
Fig. 9.2
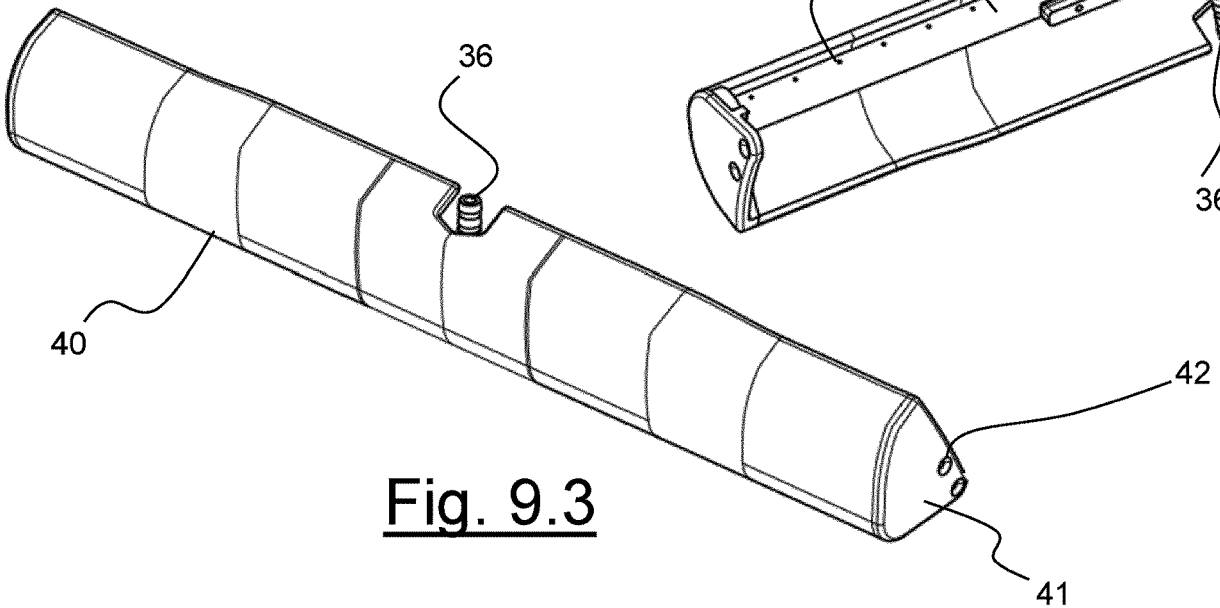
Fig. 9.3

MOTORIZED SUCTION HEAD WITH STEAM DISPENSING DEVICE

This application is the U.S. national phase of International Application No. PCT/EP2022/056288 filed Mar. 11, 2022 which designated the U.S. and claims priority to IT patent application No. 102021000005708 filed Mar. 11, 2021, the entire contents of each of which are hereby incorporated by reference.

The present invention relates to a suction head to be fitted to an electric household appliance for performing cleaning by means of suction, such as a vacuum cleaner, an electric broom, a vacuum cleaner drum or a robotic vacuum cleaner, for sucking up dust and/or fluids and/or dirt from a surface. In particular, the present invention relates to a motorized suction head provided with a device for dispensing steam and/or a cleaning and/or disinfectant substance in the liquid state or in the vaporized state.

As is known, a vacuum cleaner, an electric broom or a similar electric household appliance for performing cleaning by means of suction comprises a suction head for sucking up dust, dirt or fluids from a surface. In the sector of electric household appliances, a suction head is generally referred to by the term "brush". For the purpose of the present description, therefore, the terms "suction head" and "brush" are considered to be equivalent. Again for the purpose of the present invention, the term "vacuum cleaner" will be used with a broad meaning so as to include all those apparatus, for professional or domestic use, which perform cleaning by means of suction. Therefore, the term "vacuum cleaner" will comprise a vacuum cleaner, a canister vacuum cleaner, an electric broom, a so-called vacuum cleaner drum, a robotic vacuum cleaner, a centralized suction system for domestic or industrial use and an apparatus with a combined suction and steam/cleaning agent dispensing action.

Basically a known suction head comprises a base plate shaped so as to have at least one base plate channel open towards a surface to be vacuumed, a suction channel which, during use, is integral with the base plate and is in fluid communication with the base plate channel and optionally a covering body which can be connected to the base plate/suction channel assembly. The other end of the suction channel communicates with a suction tube usually via a rotatable joint. Also known are suction heads in which the suction channel, during use, is formed together with the covering body.

Among the vacuum cleaner brushes there are those which combine a suction system with a steam dispensing system.

U.S. Pat. No. 4,507,819 discloses a power nozzle sudser for canister type vacuum cleaner.

BRIEF DESCRIPTION OF THE INVENTION

Among the vacuum cleaner brushes there are motorized brushes (also called "active brushes") and non-motorized brushes (also called "passive brushes"). The motorized brushes are provided with a rotating roller. Rotation of the roller has the function of removing the dirt from the floors and/or carpets and/or facilitating suction thereof by the suction body of the vacuum cleaner.

The Applicant has noted that the known brushes provided with a steam dispensing system do not have a motorized rotating roller.

Typically, the known motorized brushes have an electric motor which is powered from the mains and which rotationally drives the roller.

The Applicant has examined the known brushes and has noted that the brushes with steam dispensing system do not envisage the use of a motorized rotating roller for safety reasons. In fact, it is dangerous to have electric power passing close to water and/or steam.

The Applicant has defined the aim of providing a brush with a motorized rotating roller, provided with a system for dispensing steam and/or a cleaning and/or disinfectant substance.

According to the present invention, rotation of the roller is performed by means of a battery-powered electric motor.

According to a first aspect, a motorized brush comprising a roller is provided, the roller being rotatable and being configured to rub the surface to be cleaned, an electric motor and a transmission for connecting the roller to the electric motor so as to rotate the roller, wherein the suction head further comprises a fluid dispensing device, wherein said fluid comprises steam and/or comprises a liquid with a cleaning substance and/or a disinfectant substance. The electric motor is preferably powered by direct current. The direct current could be provided by a battery. The battery could be mounted on the motorized brush (on-board arrangement). In other embodiments, the battery could be external with respect to the main body of the suction head, for instance brought by the user. According to embodiments, the battery can be arranged in a bag or the like on the back of the user or it could be hung on the user's belt. In embodiments, there is provided a transformer which is electrically connected to the motor for powering it.

The electric motor is preferably powered by a voltage less than 48V. In embodiments, the voltage powering the motor is less than 24 V.

According to embodiments, the dispensing device comprises a perforated tube comprising holes for the outflow of the fluid. The holes are configured in such a way as to be directed towards the surface to be vacuumed.

According to embodiments, the perforated tube is mounted in front of a main body of the suction head and extends substantially over the entire width of the suction head.

According to embodiments, the motorized suction head also comprises a front protective casing for protecting the perforated tube from impacts and/or contact with the user.

The perforated tube (possibly with the front protective case) can be fixed or it can be rotatable from a first working position to a second non-working position. The first position is with the holes directed downwardly, towards the surface to be vacuumed. The second non-working position can be on the main body. When the perforated tube is in the second position, the suction head can be moved closer to a wall in order to perform a more efficient vacuum action between the floor and the wall.

According to embodiments, the motorized suction head further comprises a flexible pipe for connecting the perforated tube to a steam tube of a vacuum cleaner. The flexible pipe can run in the main body of the suction head or outside it.

In other embodiments, the suction head further comprises a substantially rigid pipe for connecting the perforated tube to a steam tube of a vacuum cleaner.

According to embodiments, the motorized suction head further comprises a sleeve with a half ring with hose connector and wherein the sleeve is configured to engage with the joint of the suction head, is connected to the flexible (or substantially rigid) pipe and is configured to be connected to the steam tube of the vacuum cleaner.

According to embodiments, the sleeve comprises a fastener for fastening it to the suction tube of the vacuum cleaner.

According to embodiments, the motorized suction head further comprises a visual indicator for selecting one of a plurality of rotation speeds of the electric motor.

According to embodiments, the selector is a manual selector and preferably comprises a pushbutton.

According to another aspect, the present invention relates to a fluid dispensing device for a suction head, wherein said fluid comprises steam and/or comprises a liquid with a cleaning substance and/or a disinfectant substance, wherein the device comprises a tube with holes for the outflow of the fluid, a conveying pipe connected to the perforated tube and an attachment for connecting the conveying pipe to a steam tube of a vacuum cleaner, wherein the fluid dispensing device comprises an attaching member for attaching to a motorized suction head, wherein the motorized suction head comprises a roller, the roller being rotatable and being configured to rub the surface to be cleaned, an electric motor, either a battery or a transformer being electrically connected to the electric motor and a transmission for connecting the roller to the electric motor so as to rotate the roller.

The dispensing device may comprise a perforated tube comprising holes for the outflow of the fluid.

The perforated tube is configured to rotate from a first working configuration wherein the perforated tube is in front of a main body of the suction head to a second configuration wherein the perforated tube is above the main body of the suction head.

According to a further aspect, the present invention relates to a vacuum cleaner comprising a motorized suction head of the aforementioned type and a fluid dispensing device of the aforementioned type.

BRIEF DESCRIPTION OF THE FIGURES

The present invention will become clearer from the following detailed description, provided by way of a non-limiting example, to be read with reference to the accompanying drawings, in which:

FIGS. 8.1-8.4 are views of the joint and/or of the sleeve of the brush according to embodiments of the present invention;

FIGS. 9.1-9.3 are views of the casing and/or perforated tube for dispensing fluids or steam according to the present invention.

DETAILED DESCRIPTION

In the continuation of the present invention, for the sake of brevity, reference will be made mainly to the dispensing of steam. However, for the purposes of the present invention, the expression "dispensing of steam" (or similar expressions) will be understood as meaning the dispensing of steam and/or a liquid, which may comprise a cleaning and/or disinfectant and/or perfuming substance.

Figure 1:
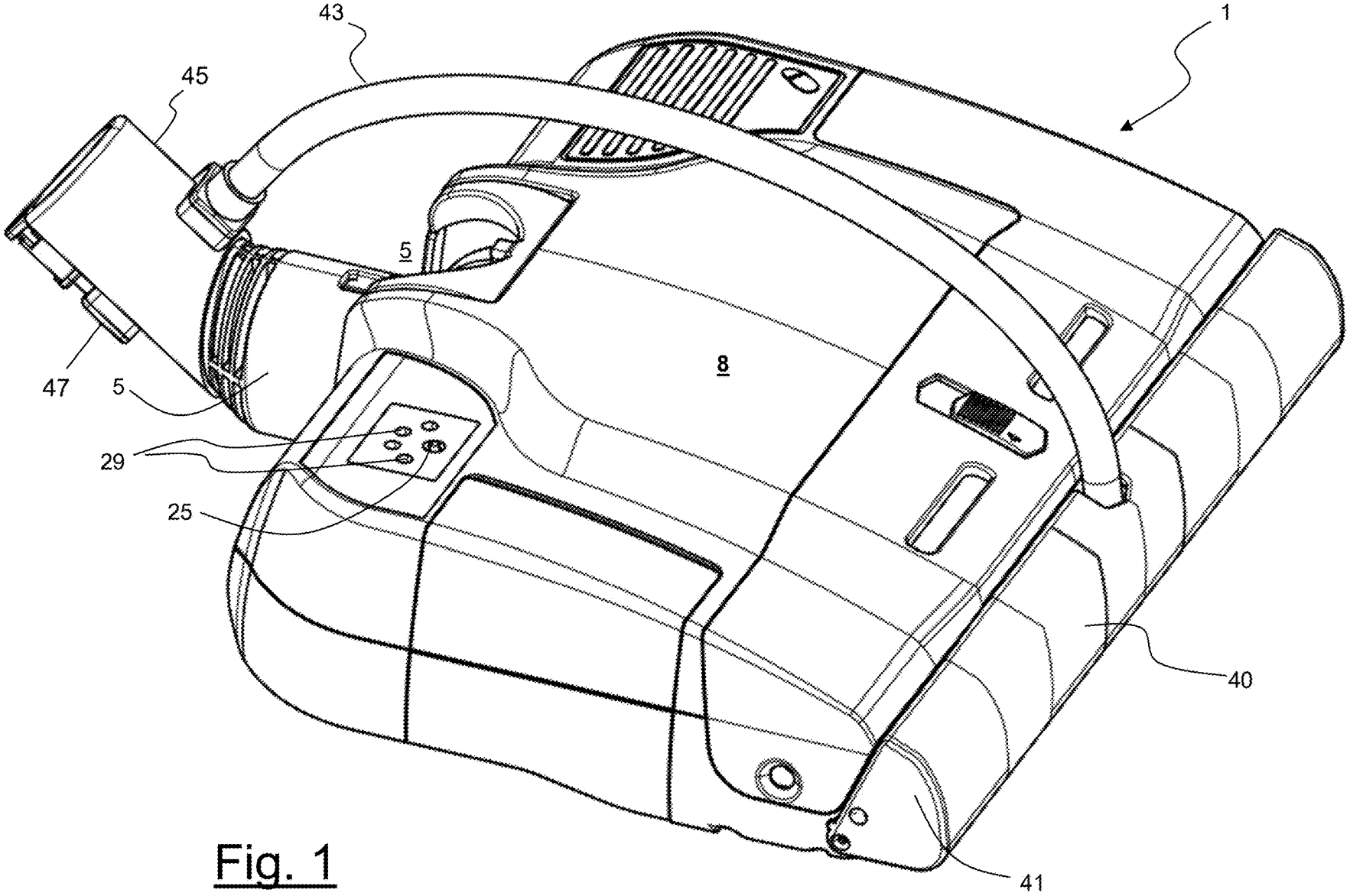
FIG. 1 is a first view of a battery-powered motorized brush with fluid or steam dispensing device according to the present invention.
Figure 2:
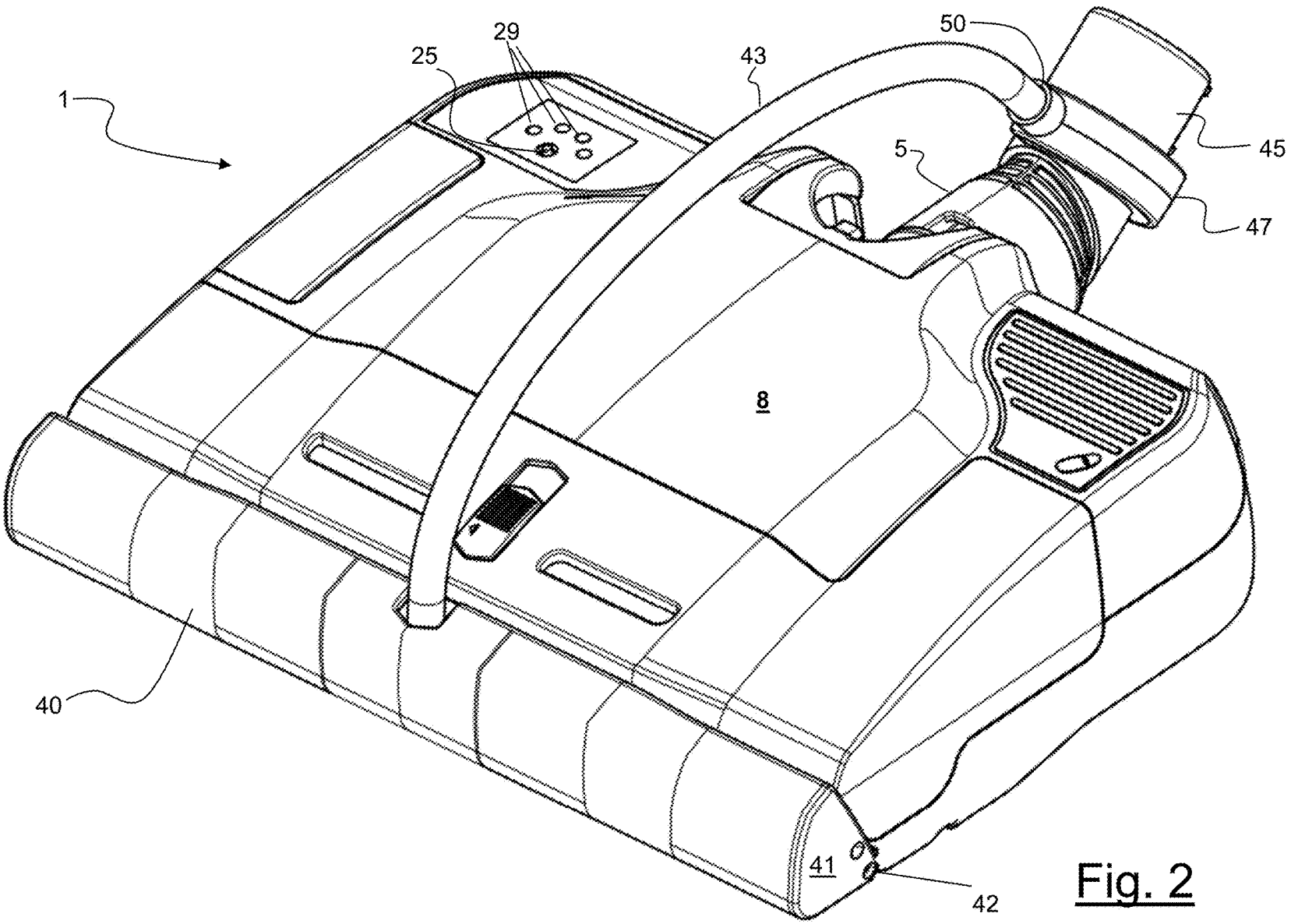
FIG. 2 is a second view of a battery-powered motorized brush with fluid or steam dispensing device according to the present invention.
Figure 3:
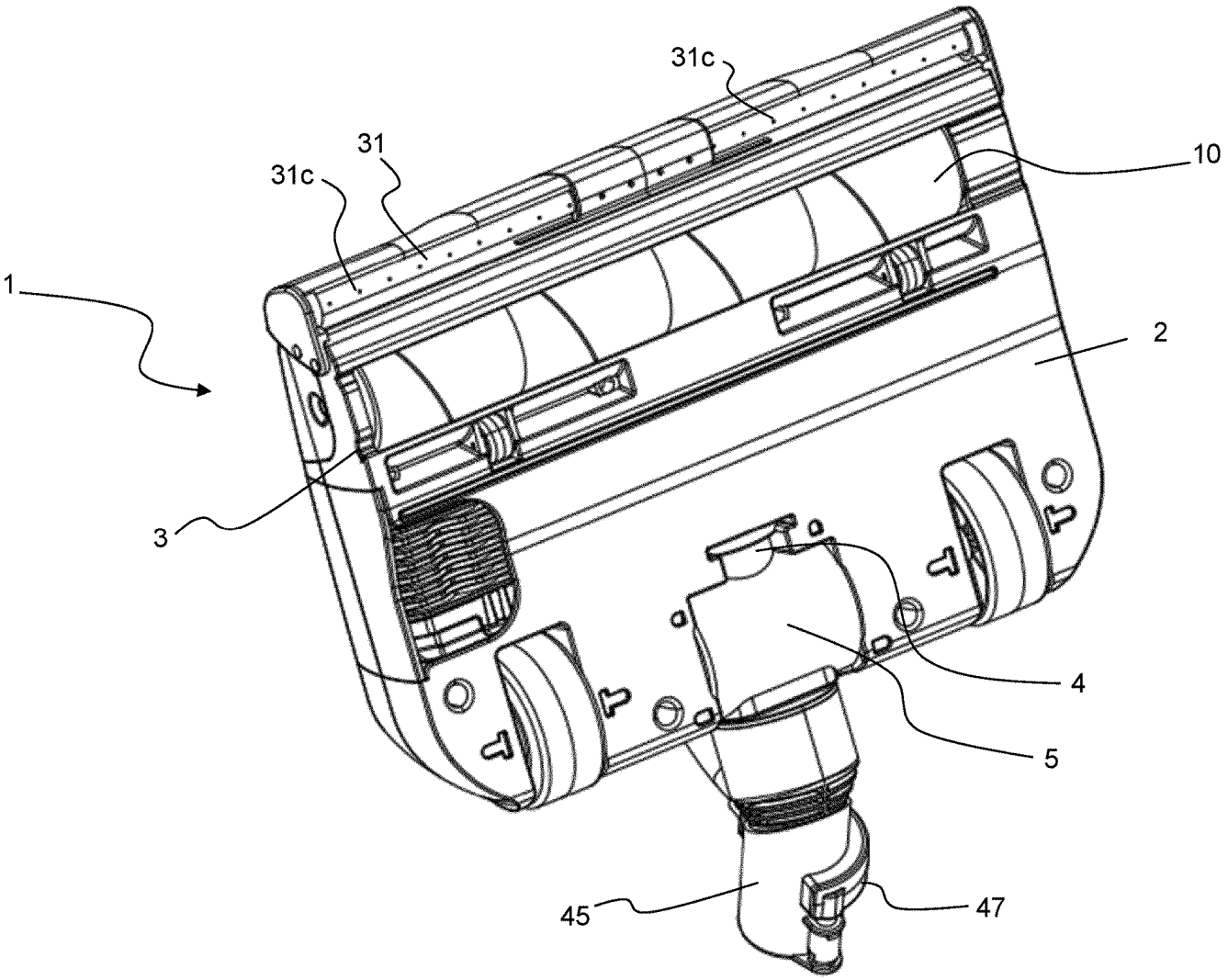
FIG. 3 is a third view (from below) of a battery-powered motorized brush with fluid or steam dispensing device according to the present invention.
Figure 4:
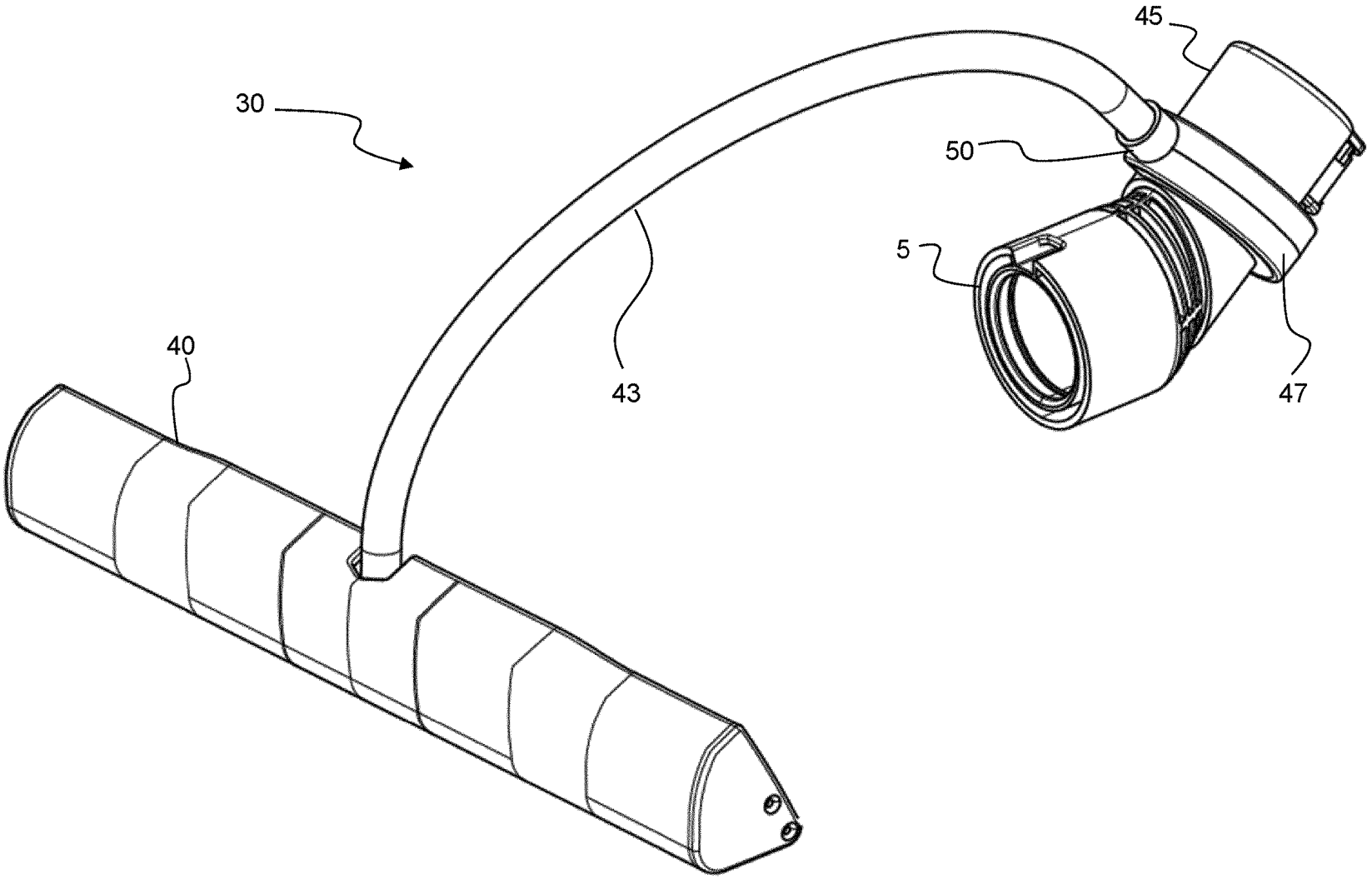
FIG. 4 is a first view of the fluid or steam dispensing device according to the present invention.
Figure 5:
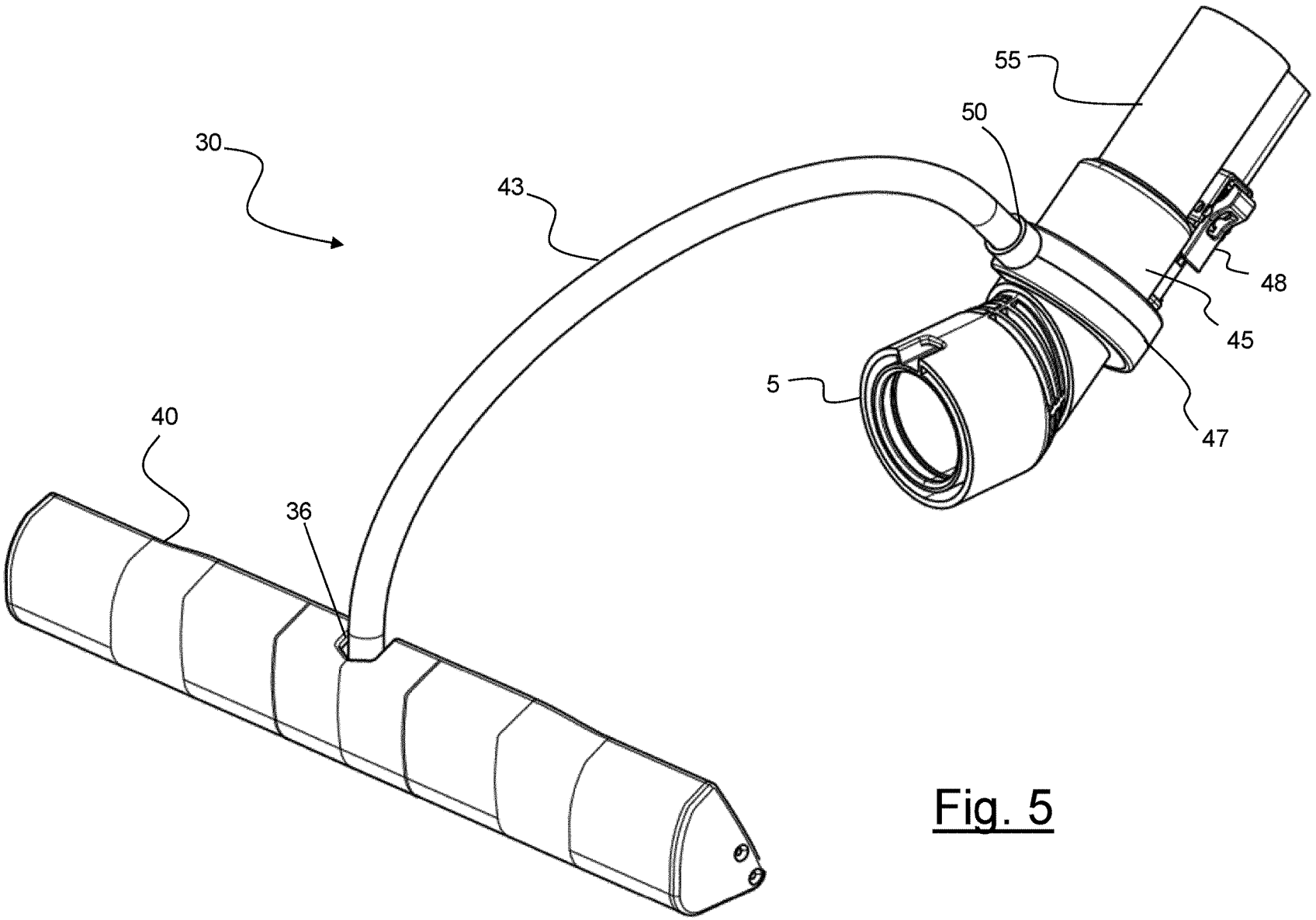
FIG. 5 is a second view of the fluid or steam dispensing device according to the present invention.
Figure 6:
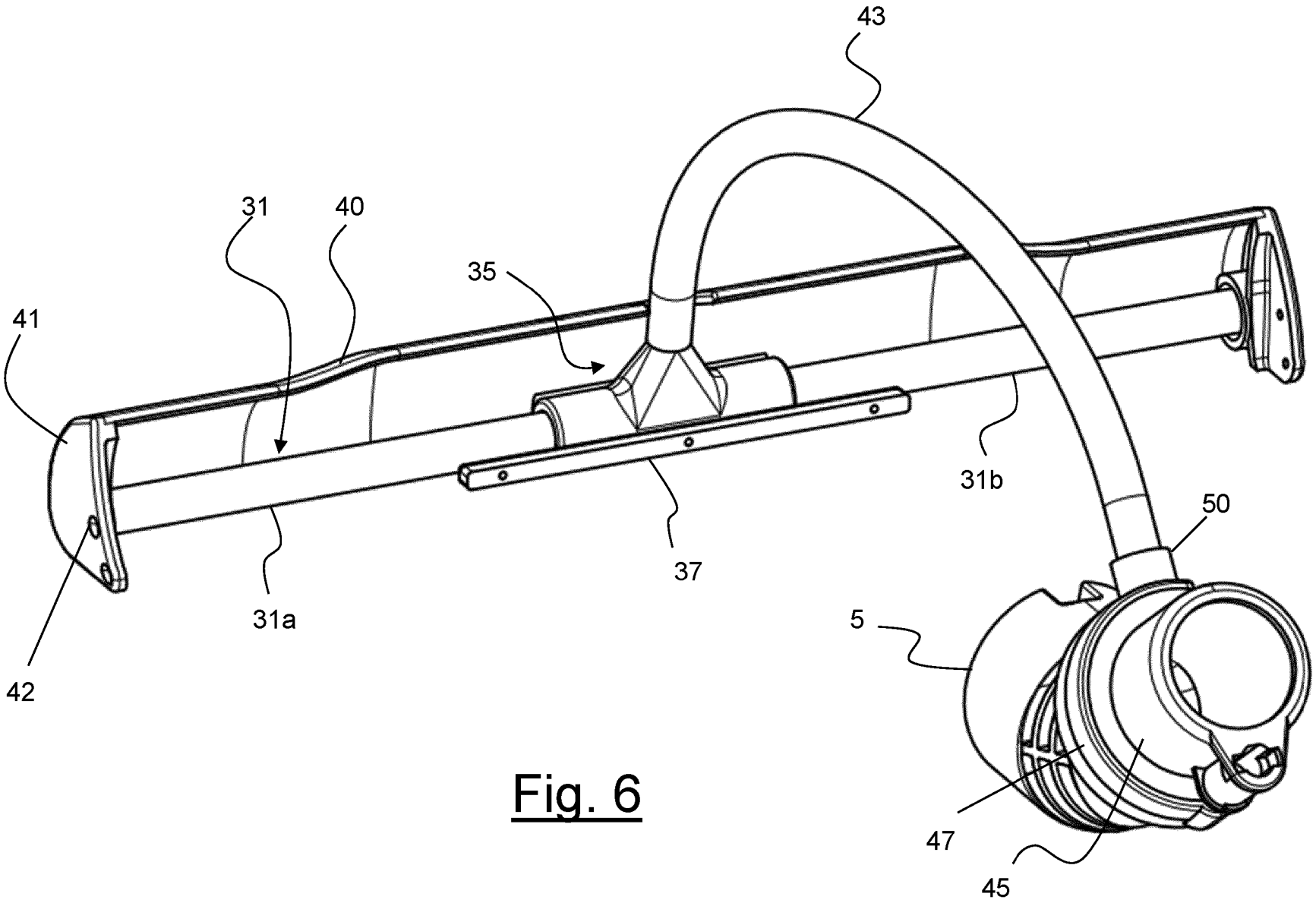
FIG. 6 is a third view of the fluid or steam dispensing device according to the present invention.
Figure 7:
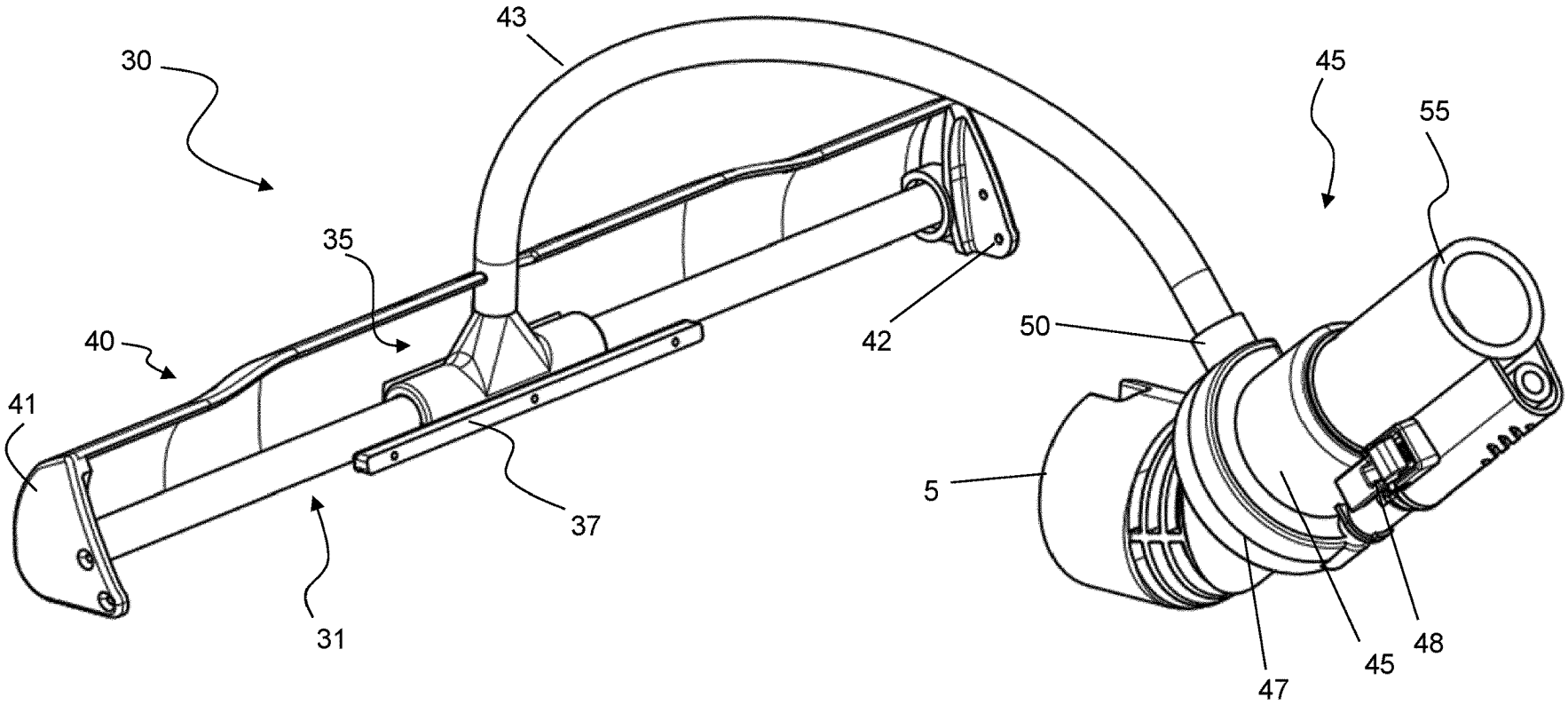
FIG. 7 is a fourth view of the fluid or steam dispensing device according to the present invention.

With reference initially to FIGS. 1-3, an embodiment of the present invention is described hereinbelow. Obviously, the form of the brush is merely provided by way of example. A brush according to the present invention may have a form different from that shown.

In the various figures, for the sake of clarity some components not considered essential for the present invention have been omitted. The brush shown in FIGS. 1, 2, 2*a* and 3 is a battery-powered motorized brush with a steam dispensing device.

With reference to the various FIGS. 1-3, the brush 1 comprises a base plate 2 with at least one base plate channel 3 open downwards, namely towards a surface to be vacuumed. Preferably, it also comprises a curved and suitably shaped suction channel 4 and a rotatable joint 5 rotating about a substantially horizontal axis. The assembly consisting of channel 3, channel 4 and joint 5 forms the suction duct.

The brush 1 has a substantially rectangular form, preferably with rounded corners. A rotating roller 10 is mounted in the vicinity of the front edge. The rotating roller 10 has a roughly cylindrical shape and its surface may be lined (at least partially) with cleaning elements. For example, the cleaning elements may comprise bristles (which may be suitably arranged in various ways, for example in helical, parallel, diverging, converging or other arrangements), rubber profiles (which may also be arranged in various ways as described above for the bristles), velvet or other soft material for avoiding damage to the surfaces (for example, in order to avoid damaging a parquet floor).

The roller 10 is preferably pivotably mounted at its ends. Preferably two coaxial pins are provided. Preferably, a first pin is idle and a second pin is motorized. According to the embodiment shown in FIG. 2*a*, the roller 10 is motorized by means of an electric motor 14 and a transmission belt 15. As an alternative to the transmission belt, a transmission chain or transmission gears may be provided. Considering the power levels involved, the working environment and the need to limit vibrations and noise, the transmission belt 15 is considered to be most advantageous.

A board 16 with a printed circuit is associated with the motor 14.

According to the present invention, different motors and power supplies may be provided depending on the use for which the brush 1 is mainly intended.

A switch 18, for example a pushbutton switch, may be provided for switching the motor 14 on/off. According to one embodiment of the present invention, this switch 18 is operated by the position of the joint 5. When the joint 5 is in the configuration shown in FIG. 1, 2 or 3 (corresponding to the operative working position) the motor is switched on. When the joint 5 is in the configuration shown in FIG. 2*a*, the motor is switched off. Preferably, the joint 5 has a certain hardness both when it is placed in the vertical position and when it is placed in the working position, so as to avoid accidental switching on/off of the motor 14 which allows rotation of the roller 10.

Advantageously, the motor 14 is powered by means of a battery 20. The battery 20 may be assembled, equally well, on the brush 1 or externally with respect thereto.

The battery 20, if it is mounted on the brush 1, is preferably extractable and able to be recharged externally with respect to the brush 1. According to one embodiment, the battery 20 may be recharged without removing it from the brush 1. According to other embodiments, recharging is not performed if the battery is installed in the brush 1.

By way of example, an 18V 3.0 Ah battery may be used.

Figure 2A:
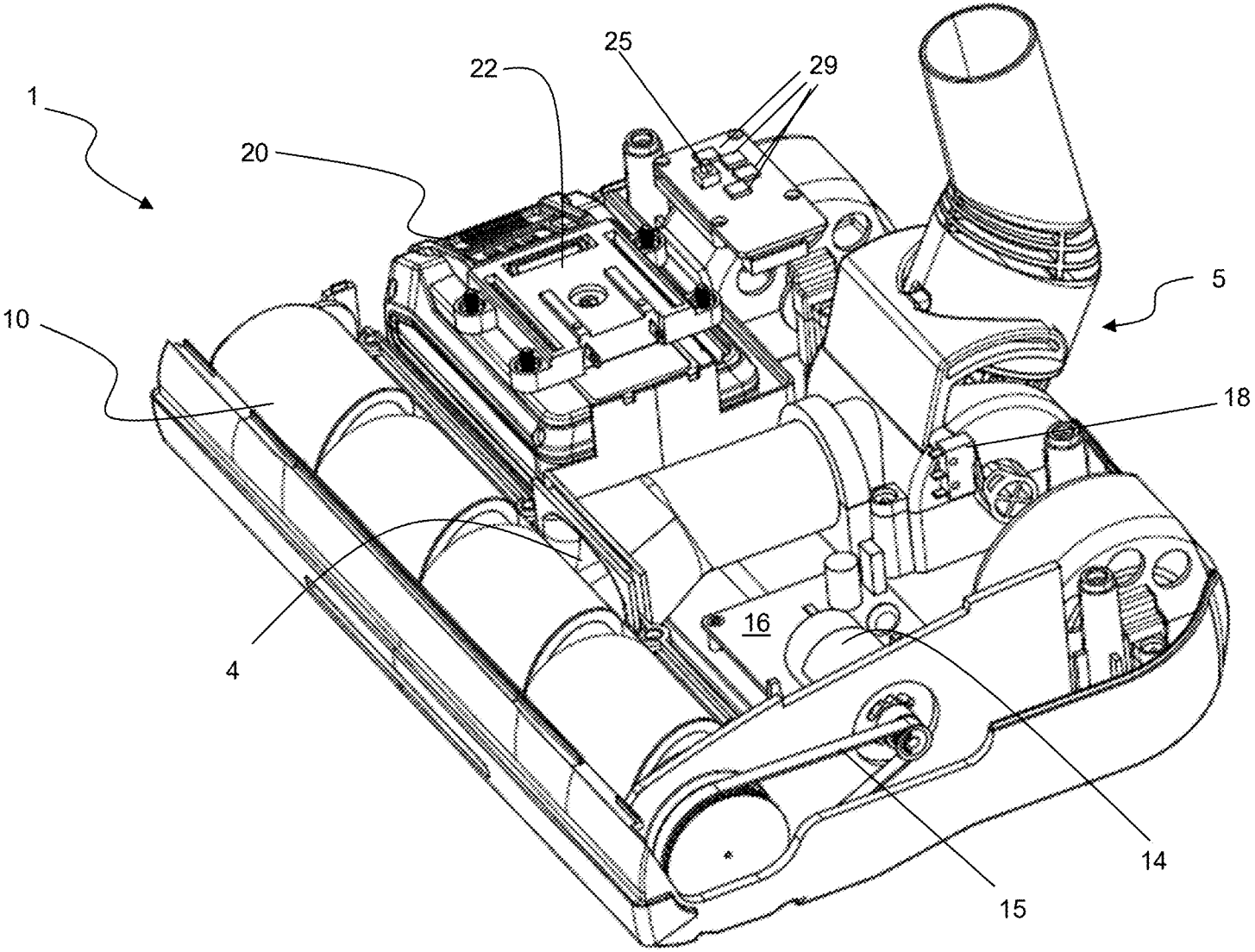
FIG. 2*a* is a view similar to FIG. 2 without brush body and without steam dispensing device so as to show some internal components.

According to the embodiment shown in FIG. 2*a*, a special battery support 22 is provided for keeping the battery 20 in position. The removable battery 20, which can be recharged externally, helps lighten the brush 1. Moreover, if the user has another charged battery available, the charged battery may be inserted during recharging of a flat battery so as to ensure continuity of operation.

According to advantageous embodiments a selector device 25 for varying the speed V of the motor 14 is provided. The speed V may be varied stepwise or continuously. According to one embodiment a single pushbutton (selector 25) with a plurality of positions (namely at least two positions) may be provided so that a different speed corresponds to each position of the pushbutton 25. According to another embodiment, two or more pushbuttons are provided and each of them is configured to set one or more speeds.

According to another embodiment a rheostat controlled by a small wheel or by a lever is provided for varying the voltage supply to the electric motor 14 in a more precise manner. Obviously other embodiments known to the person skilled in the art are possible.

According to embodiments, for the safety of the operator and to provide protection for any objects which could get caught up in the roller 10, a stop system is provided for preventing an increase in the load of the motor beyond a set value.

This situation arises, for example, when an object gets caught inside the roller and tends to stop rotation thereof. This may be noticed subsequently as an increase in the power consumption of the motor which usually results in a higher temperature and is dissipated in a component, for example in a TCO (thermal cut-off) fuse.

The Applicant has noticed that the use of a thermal fuse involves the stop signal being emitted initially when a given threshold is exceeded. Resetting is performed when the temperature falls below a value which is usually slightly lower than the activation value. At this point only a small temperature increase and hence increase in load is needed for the motor stop to be activated again. It is therefore required to wait for a certain period of time in order to allow cooling to a value which is substantially different from the threshold value.

According to the present invention, reading of the power consumption is performed in order to interrupt operation of the motor not with a "thermal" component, but using software provided in the electronic board processor and therefore based on an evaluation of the real power consumption. Reactivation allows the brush to be used without having a kind of "memory effect" as in the case of the thermal fuse.

According to one embodiment, there are four selectable speeds. The speed is selected by operating a single pushbutton 25 which is positioned on the cover of the brush 1, on the top right-hand side (viewed from the operator's position). The pushbutton 25 can be activated manually and allows switching from the speed V1 to the speed V2, to V3 and finally to V4. Pushing further the pushbutton 25 causes the speed to drop to the speed V3, and then to V2 and finally to V1.

The motor 14 is activated starting at the speed V1.

The variation in speed V of the motor 14 is performed by adjusting the power supply voltage.

The advantage of being able to vary the speed is exploited in order to adapt operation depending on the surface which is to be cleaned and/or other factors (for example in order to increase the working duration of the roller).

The speed of rotation V of the roller 10, for the same surface, affects the suction efficiency, so that it is reduced when the speed decreases.

In the case of a battery supply system a reduction in the speed results in an increase in the operational autonomy.

Tests were carried out using a battery-powered motor (16.2 VDC motor, manufacturer #1) in order to assess the variations in suction efficiency on a carpet and the differences in autonomy when the speed is varied. The results obtained are summarised in Table 1 below.

TABLE 1

| | Voltage | Suction efficiency | Autonomy [min.] |
|---|---|---|---|
| V4 | 100% | 92% | 45 |
| V3 | 80% | 90% | 55 |
| V2 | 50% | 80% | 120 |
| V1 | 30% | 66% | 200 |

As regards the variation in suction efficiency, it may be regarded as being the same, in terms of percentage variation, for hard floors and for mains-powered motors.

It can be noted that, when the voltage is 100%, the autonomy is 45 minutes. The autonomy does not change significantly when the voltage is at 80% (speed V3): it changes in fact from 45 minutes to 55 minutes. If speed V4 is changed to the speed V3 a few minutes before the battery loses all its power, the working time is increased slightly. A very significant advantage is instead obtained when the speed is changed to V2 or to V1. Compared to an autonomy of 45 minutes at the maximum speed V4, an autonomy of 120 minutes is reached at the speed V2 and 200 minutes at the minimum speed. The user may then set the speed depending on the surface to be cleaned, its condition, but also the time needed to pass over the entire surface. For example, if a working time of 60 minutes is envisaged in order to pass over the entire surface, the user may manually set the maximum speed V2, but may also set the speed V4 (or V3) for a first time interval and the speed V2 (or V1) for a second time interval. The user, in this case, will preferably start from the zone which requires more power and will set the higher speed V4 (or V3) in that zone.

The user may then gradually reduce the power depending on the surface and its condition and its area (and therefore the time needed to clean all of it). In addition to the practical advantages, there is also the undeniable advantage of energy savings and therefore reduced environmental impact.

Assessed in terms of percentage variations, the following values are obtained (both the reduction in suction efficiency and the increase in autonomy are in relation to the previous speed):

TABLE 2

| | Voltage | Percentage reduction in suction efficiency compared to the previous speed | Percentage increase in autonomy [min.] compared to the previous speed |
|---|---|---|---|
| V4 | 100% | | |
| V3 | 80% | −2% | +22% |
| V2 | 50% | −11% | +120% |
| V1 | 30% | −17% | +67% |

The percentage increase in autonomy for the speed V2 and V1 is significant compared to a relatively small variation in suction efficiency.

The position of the speed variator may be different from that shown in the figures. According to particularly advantageous embodiments, the speed adjustment device may also be placed on the vacuum cleaner handle.

According to advantageous embodiments, a corresponding visual indicator 30-29 is provided for each selected speed. For example, a first LED may be provided for the speed V1, a second LED may be provided for the speed V2, and so on. A single visual indicator may also be provided, said indicator assuming different shades of colour depending on the speed selected.

According to embodiments, a display (or other device) with an indication of the battery charging level is provided, for indicating to the user the current charging level so that the user may (if he/she wishes) adapt the speed to the remaining battery charge.

As mentioned above, preferably the rotation of the rotating roller 10 is performed by means of a switch. The switch may be associated with the joint or may be separate from it.

According to embodiments, in order to avoid start-up peaks, start-up may be performed with an acceleration ramp progressing from 0 to 100% over a time which may be for example 0.5 seconds.

According to embodiments, a similar (or the same) deceleration ramp is envisaged for switch-off.

Should objects get caught up in the roller, there will be a consequent increase in the power consumption of the motor. According to embodiments, when this consumption exceeds by a certain percentage amount (for example 50%, or 60% or 70%) the maximum power consumption of the motor, the motor is switched off. Advantageously a system which essentially does not involve reactivation delays may be used since a "thermal" safety system is not used, so that reactivation may be immediate, without having to wait for the thermal switch to be reset and without modifying the operating threshold, which in a "thermal" system is increasingly shifted.

In order to switch on the motor again it is required to simply adjust the position of the joint, moving it into the "off" position and then back into the "on" position.

Initially, the motor stop value for an emergency may be set, for example, to 40% less than the values indicated above. Preferably, the values is set during calibration of the board and cannot be modified by the user.

Depending on operation on a hard floor (HF) or carpet, different roller rotation speeds may be used.

From the tests carried out it seems that the speed on an HF must be about 60% of the maximum speed which is instead used on carpets.

The variation in this speed is achieved using the aforementioned selector which allows operation at 100% or 60% of the motor speed.

An additional option is that of having two "high" speeds (100% and 80%) and two low speeds (50% and 35%) in order to manage more efficiently the different surfaces to be cleaned. In this case also the choice will be made using a selector.

According to the present invention, the brush is provided with a fluid dispenser or fluid dispensing device 30. The fluid dispenser or fluid dispensing device 30 is shown mounted on the brush shown in FIGS. 1-3 and is shown separated from the brush in FIGS. 4-10. Preferably, the fluid dispensing device 30 comprises a perforated tube 31. In some embodiments, the fluid dispensing device comprises a T-piece 35 with a hose connection. In some embodiments, the fluid dispensing device comprises a front protective casing 40. The fluid dispenser or fluid dispensing device 30 is configured to dispense a fluid, which may be steam and/or a liquid. Therefore, the component 30 may be referred to as "fluid dispensing device", "steam dispensing device", "fluid dispensing element", and/or "fluid dispenser".

The front casing 40 is preferably shaped so as to be adapted to the shape of the front side of the brush 1. The front casing 40 protects (at the front, on the sides and at the top) the perforated tube 31 from impacts and from accidental contact with the operator. Obviously, the front casing 40 leaves a space open downwards for the free dispensing of the steam towards the surface to be cleaned. The casing 40 is preferably connected to the brush by means of screws which penetrate inside holes 42 present in the side surfaces 41 of the casing 40. The casing is preferably made of a metallic or thermoplastic material for example nylon, possibly with a glass fibre filler (PA6+GF). In embodiments, the casing supports the perforated tube 31.

The perforated tube 31 is preferably a tube with a circular cross-section made of aluminium or aluminium alloy. Alternatively, it could be made of a different material, for example a metallic or thermoplastic material, for example nylon, possibly with a glass fibre filler (PA6+GF). In any case, the material chosen must be resistant to steam and/or to the cleaning and disinfectant products.

Figure 10:
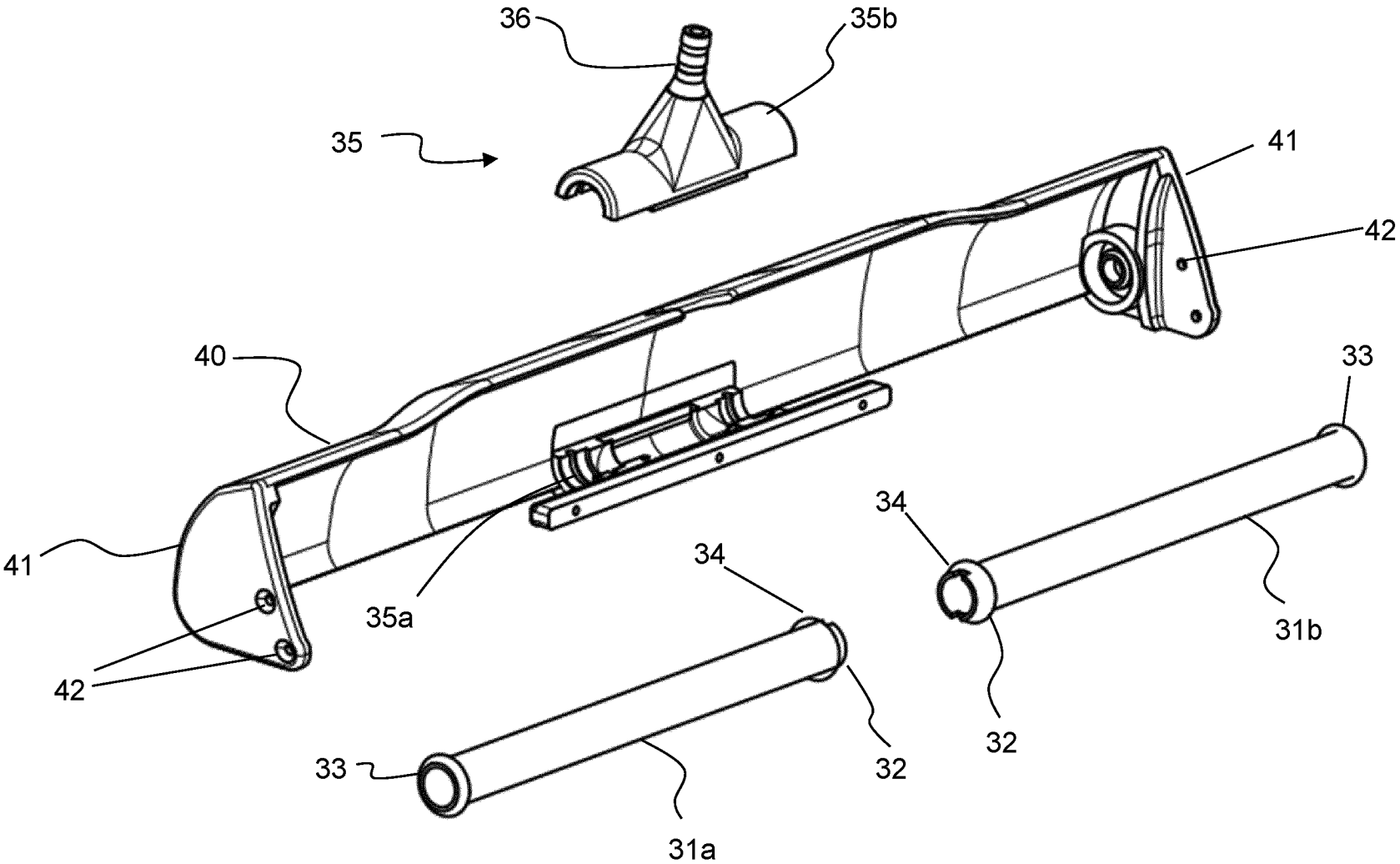
FIG. 10 is an exploded view of the casing, the perforated tube and other components of the dispensing device according to the present invention.

According to embodiments, the perforated tube 31 consists of two parts (31*a*, 31*b*) as shown in FIG. 10. Each part preferably comprises a groove 32 for a sealing gasket or O-ring. Each perforated tube part has an outer end 33 configured to be closed, for example by the side surfaces 41 of the casing 40, and an inner end 34 configured to engage with the T-piece 35. Preferably, the inner end 34 of each perforated tube part has an incision for fixing a position and preventing the perforated tube 31 from rotating with respect to the predetermined position.

According to embodiments, the perforated tube 31 comprises holes 31*c* directed downwards. Preferably the holes 31*c* are equally spaced from each other.

The inner end 34 of each perforated tube 31*a*, 31*b* is configured to engage with the T-piece 35. Preferably, the T-piece comprises a first half-shell 35*a* integral with the inner surface of the casing 40 and second half-shell 35*b* with a hose connector 36. The two half-shells are preferably ultrasound-welded or in any case sealingly closed (for example by means of gluing or with screws or other similar connection means). Preferably, the first half-shell 35*a* also comprises steam distribution holes 35*c*, like the two parts 31*a*, 31*b* of the perforated tube 31.

According to embodiments, a plastic front fixing element 37 is provided opposite the T-piece 35 for performing fixing to the brush body.

The steam dispensing device comprises a flexible pipe 43 with a first end connected to the T-piece 35. The flexible pipe 43 is made of material resistant to the heat and/or to the chemical agents which may be present in the fluid to be dispensed. In embodiments, the flexible pipe 43 is protected by a protective braiding which prevents direct contact with the user's hands (or other parts of the body).

According to embodiments, the second end of the flexible pipe 43 is connected to a half-ring 47 fixed to a sleeve 45. The half-ring has a hose connection 50. The sleeve 45 is configured to be fitted onto the joint 5 of the brush 1. The sleeve 45 is configured to engage with the suction tube 55 of the vacuum cleaner. A lever 48, a snap-engaging system or a ring nut is provided for locking together the sleeve and the suction tube. A connection 49 for connecting a steam tube of the vacuum cleaner to the half-ring 47 is also provided, so as to dispense steam inside the flexible pipe 43 as far as the perforated tube 31.

Advantageously, the steam dispensing device 30 may also be associated with a brush having a shape different from that shown. Basically, apart from the specific form and size of certain components, the device 30 can be associated with a plurality of brush designs, including non-active designs. Therefore, the present invention also provides for protection of the device 30 in itself.

According to embodiments, the power supply voltage of the motor is less than 34 V. However, according to other embodiments, but the regulations could change in the future, it could therefore be that our steam dispensing system may also be used for brushes which are powered with different voltages (220V, 110V, etc.).

According to embodiments, dispensing of the steam occurs in the front part of the brush. However, according to the present invention, dispensing of the steam may also occur in a different position. For example, it may occur in the rear part or in the central part of the brush. Alternatively, it may occur along the entire perimeter of the brush or along a part thereof.

The invention claimed is:

1. A motorized suction head comprising:

a main body;

a roller, the roller being rotatable and being configured to rub a surface to be cleaned;

an electric motor;

a battery and/or a transformer electrically connected to the electric motor;

a transmission configured to connect the roller to the electric motor so as to rotate the roller;

wherein the suction head further comprises a fluid dispensing device configured to dispense a fluid;

wherein the fluid comprises steam and/or comprises a liquid with a cleaning substance and/or a disinfectant substance;

wherein the fluid dispensing device comprises a perforated tube comprising holes for the outflow of the fluid and a T-piece with a hose connection;

wherein the perforated tube is mounted in front of the main body of the suction head and extends substantially over an entire width of the suction head.

2. The motorized suction head of claim 1, further comprising a front protective casing for protecting the perforated tube from impacts and/or contact with the user.

3. The motorized suction head of claim 1, wherein the perforated tube is configured to rotate from a first working configuration wherein the perforated tube is in front of the main body of the motorized suction head to a second configuration wherein the perforated tube is above the main body of the motorized suction head.

4. The motorized suction head of claim 1, further comprising a pipe for connecting the perforated tube to a steam tube of a vacuum cleaner, wherein the pipe is either flexible or substantially rigid.

5. The motorized suction head of claim 4, further comprising a sleeve with a half ring with hose connector and wherein the sleeve is configured to engage with the joint of the suction head, is connected to the pipe and is configured to be connected to the steam tube of the vacuum cleaner.

6. The motorized suction head of claim 5, wherein the sleeve comprises a fastener for fastening the sleeve to the suction tube of the motorized vacuum cleaner.

7. The motorized suction head of claim 1, wherein the electric motor comprises a plurality of rotation speeds, the motorized suction head further comprising a speed selector for selecting one of the plurality of rotation speeds of the electric motor.

8. The motorized suction head of claim 7, wherein the speed selector is a manual speed selector.

9. The motorized suction head of claim 8, wherein the battery is rechargeable.

* * * * *